US005129582A

United States Patent [19]

Rieke et al.

[11] Patent Number: 5,129,582

[45] Date of Patent: Jul. 14, 1992

[54] TURBINE INJECTOR DEVICE AND METHOD

[75] Inventors: Roger L. Rieke; Sajjad A. Chaudhry, both of Phoenix, Ariz.

[73] Assignee: General Turbine Systems, Inc., Tempe, Ariz.

[21] Appl. No.: 634,103

[22] Filed: Dec. 26, 1990

[51] Int. Cl.[5] ..... B05B 7/08; F23L 7/00

[52] U.S. Cl. ..... 239/424.5; 239/601; 431/190

[58] Field of Search ..... 239/423, 424, 424.5, 239/601; 60/39.55, 39.58, 740; 431/153, 190

[56] References Cited

U.S. PATENT DOCUMENTS 2,965,303 12/1960 Jackson ..... 239/424.5 X
3,028,102 4/1962 Davies et al. ..... 239/424 X
3,687,375 8/1972 Griffiths ..... 239/601 X
4,337,618 7/1982 Hughes et al. ..... 239/424.5 X
4,483,137 11/1984 Faulkner ..... 60/39.55
4,600,151 7/1986 Bradley ..... 239/424 X
4,977,740 12/1990 Madden et al. ..... 239/424.5 X

*Primary Examiner*—Andres Kashnikow
*Assistant Examiner*—William Grant
*Attorney, Agent, or Firm*—Harry M. Weiss

[57] ABSTRACT

A turbine injector device and method for minimizing contamination and pollution from the gas openings of the device which is used for gas turbine engines. The injector device includes an upper inlet portion and a lower outlet portion. The upper inlet portion is preferably a solid bar having a gas passage and a water passage. The lower outlet portion has a central water nozzle portion having a cruciform-shaped water outlet opening which forms an inner shaped water flow pattern. The lower outlet portion also has a radially outer gas nozzle portion having peripherally spaced gas outlet openings which form an outer conically shaped gas flow pattern surrounding the inner shaped water flow pattern.

17 Claims, 2 Drawing Sheets

TURBINE INJECTOR DEVICE AND METHOD

BACKGROUND OF THE INVENTION

1. Field of Invention

This invention generally relates to a turbine injector device and method, and, in particular, this invention relates to an improved gas turbine and water injector device and method which uses a central axial nozzle portion having a single cruciform-shaped water opening and having a radially outer tapered conical portion having a plurality of peripherally spaced gas openings.

2. Description of the Prior Art

The prior art gas turbine injector device usually included a separated or spaced gas nozzle portion separated or spaced apart from a water nozzle portion.

One significant problem associated with the prior art gas turbine device injector is that the device was not very efficient and the design of the gas nozzle portion produced an excess amount of contamination and pollution.

SUMMARY OF INVENTION

According to the present invention, a turbine injector device and method are provided. The turbine injector device comprises, an outlet portion and an inlet portion, the outlet portion comprises a central axial water nozzle portion having an axial cruciform-shaped water opening and having a radially outer tapered conical gas nozzle portion with a plurality of peripherally spaced apart gas openings.

By using the axial cruciform-shaped water opening and by using the radially outer peripherally spaced apart gas openings, a cruciform shaped water flow is disposed within a conically shaped gas flow whereby the contamination and pollution from the gas openings are minimized.

Accordingly, it is an object of this invention to provide an improved turbine injector device and method.

It is another object of this invention to provide an improved turbine injector device and method that is more efficient than prior turbine injector devices and methods.

It is still another object of this invention to provide an improved turbine injector device and method that reduces contamination and pollution caused by prior turbine injector devices and methods.

The foregoing and other objects, features and advantages will be apparent from the following description of the preferred embodiment of the invention as illustrated in the accompanying drawings.

DESCRIPTION OF THE PREFERRED EMBODIMENT

Figure 1:
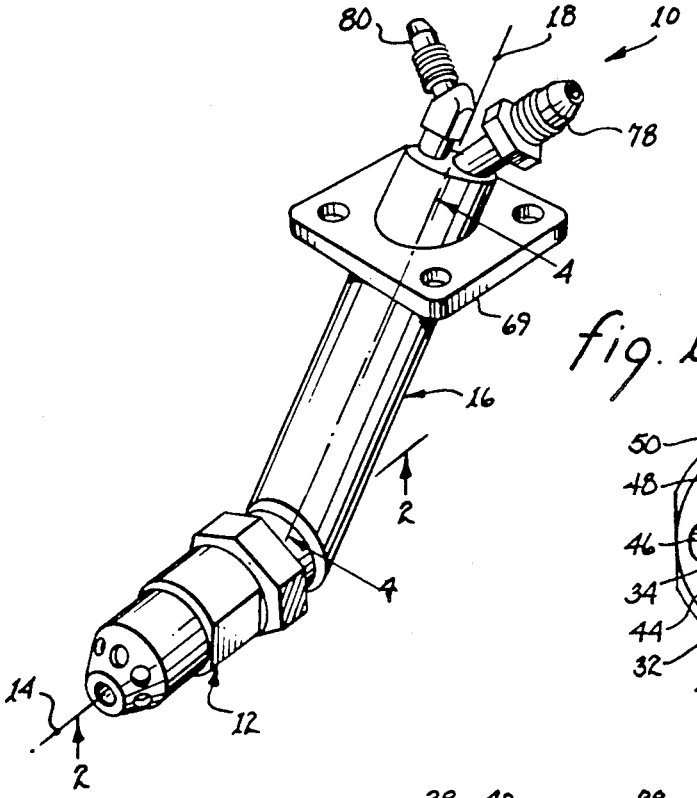
FIG. 1 is a perspective view of a turbine injector device according to the invention.

As shown in FIG. 1, a turbine gas and water injector device 10 is provided. Injector device 10 has a lower outlet portion 12, which has an axis 14, and has an upper inlet portion 16, which has an axis 18.

Figure 3:
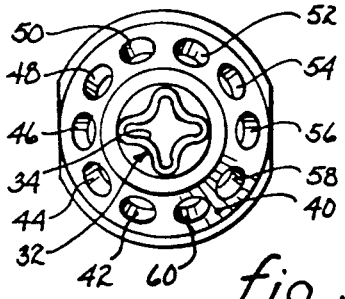
FIG. 3 is an elevation front view of the outlet portion of the turbine injector device as taken along line 3—3 of FIG. 2.
Figure 2:
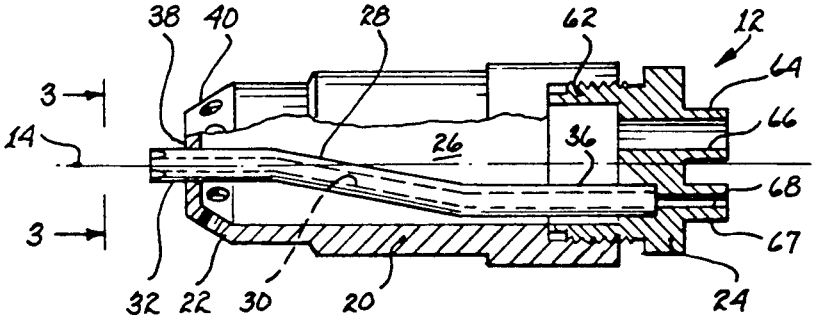
FIG. 2 is a section view as taken along line 2—2 of FIG. 1.

As shown in FIGS. 2 and 3, lower outlet portion 12 has a preferably peripheral wall 20, which is preferably a stepped wall, and has a tapered left end wall 22, which is fixedly connected to peripheral wall 20, and has a right end wall 24, which is preferably threaded into peripheral wall 20. Walls 20, 22 and 24 enclose an internal space or gas passage 26.

Lower outlet portion 12 also comprises a shaped tubular member or water tube 28 which surrounds a water passage 30. Water tube 28 has a left end portion 32, which is preferably centrally supported by left end wall 22 and is mounted coaxially therewith. Tube left end 32 preferably has a single cruciform-shaped nozzle opening or aperture 34 (see FIG. 3). Tube 28 also has a right end portion 36 (see FIG. 2), which extends into and is preferably supported by right end wall 24. Tube end 32 preferably projects axially outwardly a selected distance from the exterior portion of wall 22 thereby providing a cruciform-shaped stream of water in front of and within the outer peripheral gas stream exiting the lower outlet portion 12.

Left end wall 22 has a central water nozzle portion 38 (see FIG. 2), which is preferably disposed normal to axis 14. Left end wall 22 also has a preferably tapered conical gas nozzle portion 40, which is preferably disposed radially outwardly of central nozzle portion 38. Conical gas nozzle portion 40 has preferably ten gas outlet openings or apertures 42, 44, 46, 48, 50, 52, 56, 58, 60 (see FIG. 3).

Right end wall 24 has a preferably threaded cylindrical flange 62 (see FIG. 2), which is threaded into a right end internally threaded portion of peripheral wall 20 thereby providing a connection thereto. Right end wall 24 also has a preferably cylindrically shaped gas projection portion 64, which has a gas inlet passage 66, that connects to gas passage 26. Right end wall 24 also has a smaller diameter preferably cylindrically shaped water projection portion 67, which has a water inlet passage 68 that connects to water tube passage 30.

Figure 4:
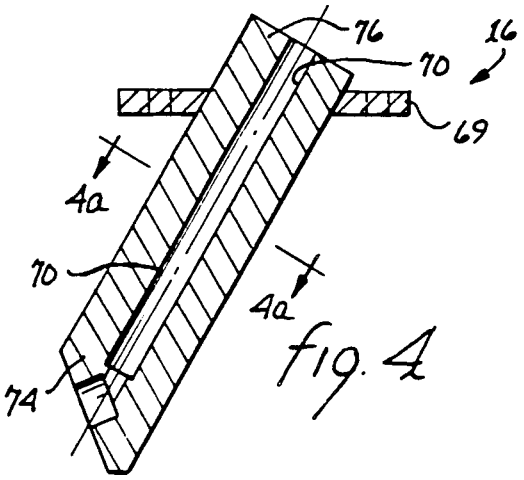
FIG. 4 is a section view as taken along line 4—4 of Figure 1.
Figure 4A:
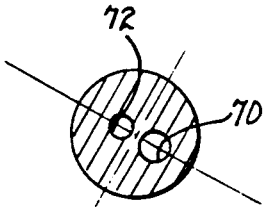
FIG. 4*a* is a sectional view taken along line 4*a*—4*a* of FIG. 4 showing the water and gas conduits within the turbine injector device of FIG. 1.

As shown in FIGS. 4 and 4*a*, upper inlet portion 16, which is preferably configured as a solid bar, has a turbine mounting plate 69 (see also FIG. 1), for bolting upper inlet portion 16 to a gas turbine engine. Upper inlet portion 16 also has a gas passage 70 which connects to gas inlet passage 66 and a smaller water passage 72 (see FIG. 4*a*) which connects to water inlet passage 68.

Upper inlet portion 16 also has a left lower end face 74 and a right upper end face 76 (see FIG. 4). Gas passage 70 at left lower end face 74 receives gas projection 64. Water passage 72 (see FIG. 4*a*) at left lower end face 74 receives water projection 67 (see FIG. 2).

Upper portion 16 also has a gas fitting 78, which connects to gas passage 70 at right end upper face 76.

Upper inlet portion 16 also has a water fitting 80, which connects to water passage 72 at right end upper face 76.

Figure 5:
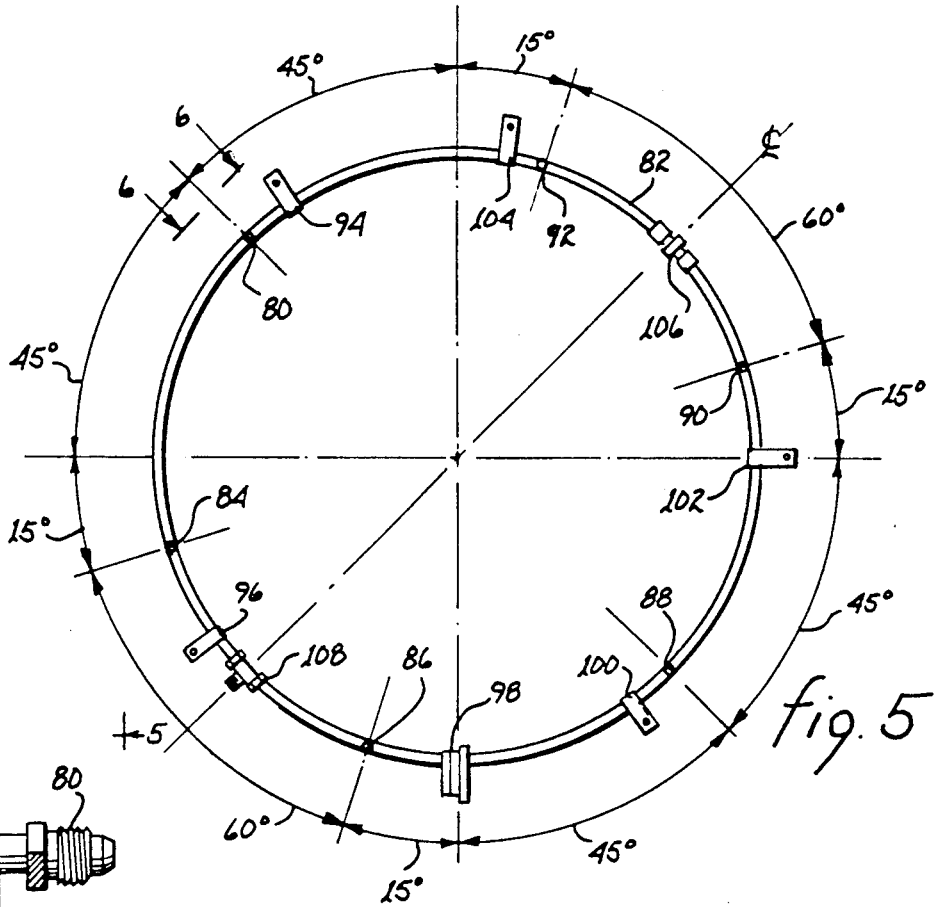
FIG. 5 is an elevation view of the water manifold line to which is connected the water nozzle of the turbine injector device of FIG. 1.
Figure 6:
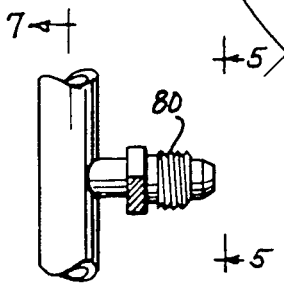
FIG. 6 is a view as taken along line 6—6 of FIG. 5 showing the water manifold line and one of the six water nozzles connected to the water nozzle manifold line.
Figure 7:
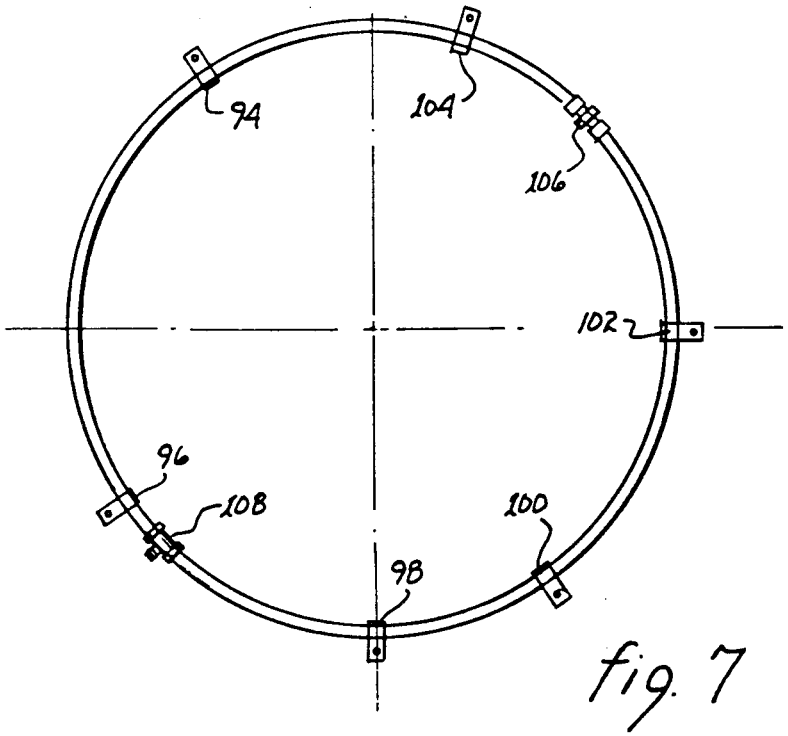
FIG. 7 is an elevation view of the water manifold line of FIGS. 6 showing the connections or brackets for bolting the water manifold line to a gas turbine engine.

As shown in FIGS. 5, 6, and 7, water fitting 80 (see FIGS. 5 and 6) connects to a water manifold 82. Manifold 82 has five additional injector water fittings 84, 86, 88, 90, 92, which are identical in construction to water fitting 80A. A connection, not shown, connects water fitting 80A to water fitting 80 (See FIG. 1) of the injector device 10. Similarly, water fittings 84, 86, 88, 90, and 92 are connected by connection (not shown) to five additional injector devices (not shown) which are substantially identical to injector device 10. Water fittings 80, 84, 86, 88, 90, 92 are spaced apart at preferably approximately sixty degrees.

Manifold 82 also has preferably six U-shaped turbine brackets 94, 96, 98, 100, 102, 104 (see FIGS. 5 and 7), for bolting manifold 82 to the gas turbine engine. Manifold 82 also has a union or connection 106, and has a T-fitting or water supply connection 108, which is disposed diametrically opposite to connection 106.

METHOD OF OPERATION

In operation, water under pressure enters supply fitting 108, then passes through manifold 82 out water fitting 80A through a connection (not shown) into water fitting 80 of the injector device 10, then passes through water passage 68, then passes through tube passage 30, and then passes out through cruciform-shaped outlet opening 34. Gas under pressure simultaneously enters gas fitting 78 by means of a connection (not shown) to a gas source (not shown), then passes through gas passage 70, then passes through gas passages 66 and 26, and then passes out through gas outlet openings 42, 44, 46, 48, 50, 52, 54, 56, 58, and 60.

The water upon exiting has a cruciform-shaped inner flow configuration or shape which is ejected slightly in front of the gas stream; and the gas upon exiting through the 10 tapered gas openings has a conically shaped outer flow configuration or shape surrounding the inner flow of water. In this way, contamination and pollution at the gas outlet openings 42, 44, 46, 48, 50, 52, 54, 56, 58, 60 are minimized.

While the invention has been described in its preferred embodiment, it is to be understood that the words which have been used are words of description rather than limitation and that changes may be made within the purview of the appended claims without departing from the true scope and spirit of the invention in its broader aspects.

The embodiments of an invention in which an exclusive property or right is claimed are defined in the following claims:

1. A turbine injector device for a gas turbine engine comprising:

an outlet portion having a first axis;

an inlet portion having a second axis;

said outlet portion comprising a central axial water nozzle portion having a selectively shaped axial water outlet opening; and said outlet portion comprising a radially outer conically shaped gas nozzle portion having a plurality of peripherally spaced gas outlet openings, wherein the selectively shaped axial water outlet opening is a cruciform-shaped axial water outlet opening.

2. The injector device of claim 1 wherein said peripherally spaced gas outlet openings of said radially outer conically shaped gas nozzle portion surrounds said cruciform-shaped axial water outlet opening.

3. The injector device of claim 2 wherein said cruciform-shaped axial water outlet opening extends beyond said peripherally spaced gas outlet openings of said radially outer conically shaped gas nozzle portion.

4. The injector device of claim 3 wherein each of said plurality of peripherally spaced gas outlet openings being a cylindrical opening.

5. The injector device of claim 4 wherein said plurality of gas outlet openings is 10 gas outlet openings.

6. A turbine injector device for a gas turbine engine comprising;

an outlet portion having a first axis;

an inlet portion having a second axis;

said outlet portion comprising a central axial water nozzle portion having a selectively shaped axial water outlet opening; and said outlet portion comprising a radially outer conically shaped gas nozzle portion having a plurality of peripherally shaped gas outlet openings, wherein the outlet portion includes;

a peripheral wall and a left end wall and a right end wall enclosing a gas passage;

a water tube having a water passage and having a left end tube portion supported by the left wall and having a right end tube portion supported by the right wall;

said left end wall having said central axial water nozzle portion and having said radially outer conically shaped gas nozzle portion;

said wall enclosed gas passage connecting to the peripherally spaced gas outlet openings; and said water passage of said water tube connecting to said selectively shaped axial water outlet opening.

7. The injector device of claim 6 wherein the inlet portion includes:

a bar having an inner water passage connecting to the water passage of said water tube and having an inlet water fitting connecting to the inner water passage;

said bar having an inner gas passage connecting to the wall enclosed gas passage and having an inlet fitting connecting to the inner gas passage;

said inlet water fitting having a manifold; and said manifold having a water supply fitting.

8. The injector device of claim 7 wherein the selectively shaped axial water outlet opening is a cruciform-shaped axial water outlet opening.

9. The injector device of claim 8 wherein said peripherally spaced gas outlet openings of said radially outer conically shaped gas nozzle portion surrounds said cruciform-shaped axial water outlet opening.

10. The injector device of claim 9 wherein said cruciform-shaped axial water outlet opening extends beyond said peripherally spaced gas outlet openings of said radially outer conically shaped gas nozzle portion.

11. The injector device of claim 10 wherein each of said plurality of peripherally spaced gas outlet openings being a cylindrical opening.

12. The injector device of claim 11 wherein said plurality of gas outlet openings is 10 gas outlet openings.

13. A process of making a turbine injector device, including the steps of:

forming an outlet portion having a first axis;

forming an inlet portion having a second axis;

forming in said outlet portion a central axial water nozzle portion having a selectively shaped axial water outlet opening; and forming in said outlet portion a radially outer conically shaped gas nozzle portion having a plurality of peripherally shaped gas outlet openings, wherein said selectively shaped axial water opening is a cruciform-shaped water opening.

14. The process of claim 13 wherein said peripherally spaced gas outlet openings of said radially outer conically shaped gas nozzle portion surrounds said cruciform-shaped axial water outlet opening.

15. The process of claim 14 wherein said cruciform-shaped axial water outlet opening extends beyond said peripherally spaced gas outlet openings.

16. The process of claim 15 wherein each of said plurality of peripherally spaced gas outlet openings being a cylindrical opening.

17. The process of claim 16 wherein said plurality of gas outlet openings is 10 gas outlet openings.

* * * * *